United States Patent [19]

Riley et al.

[11] Patent Number: 4,614,049

[45] Date of Patent: Sep. 30, 1986

[54] SMOCKING FRAME

[76] Inventors: Priscilla C. Riley, 4212 Frederick Farms Dr., Midlothian, Va. 23113; Charles R. Riley, 1 Highland Rd., Richmond, Va. 23228

[21] Appl. No.: 654,218

[22] Filed: Sep. 25, 1984

[51] Int. Cl.[4] ..... D06C 3/08

[52] U.S. Cl. ..... 38/102.91; 242/673 F

[58] Field of Search ..... 38/102.1, 102.4, 102.91, 38/102.6; 160/378, 385, 387; 242/67.3 F; 112/133, 174; 223/1

[56] References Cited

U.S. PATENT DOCUMENTS

| | | | |
|---|---|---|---|
| 7,488 | 6/1850 | Cook | 242/67.3 F |
| 153,010 | 7/1874 | Nolan | 38/102.5 |
| 308,406 | 11/1884 | Elder | 242/67.3 F |
| 362,230 | 5/1887 | Schaubel | 38/102.4 |
| 3,098,280 | 7/1963 | Harris et al. | 38/102.4 |
| 3,859,742 | 1/1975 | Amaro | 38/102.4 |
| 3,979,844 | 9/1976 | Smith | 38/102.91 |

FOREIGN PATENT DOCUMENTS

| | | | |
|---|---|---|---|
| 46562 | 7/1888 | Fed. Rep. of Germany | 38/102.1 |

*Primary Examiner*—Werner H. Schroeder
*Assistant Examiner*—Andrew M. Falik
*Attorney, Agent, or Firm*—John S. Roberts, Jr.

[57] ABSTRACT

A hand-held smocking apparatus consisting of a crossbar and at least two fabric covered dowels rotatably and perpendicularly attached to said crossbar is suitable for performing needlework on pre-pleated material without tangling, snagging, or crushing the material.

3 Claims, 1 Drawing Figure

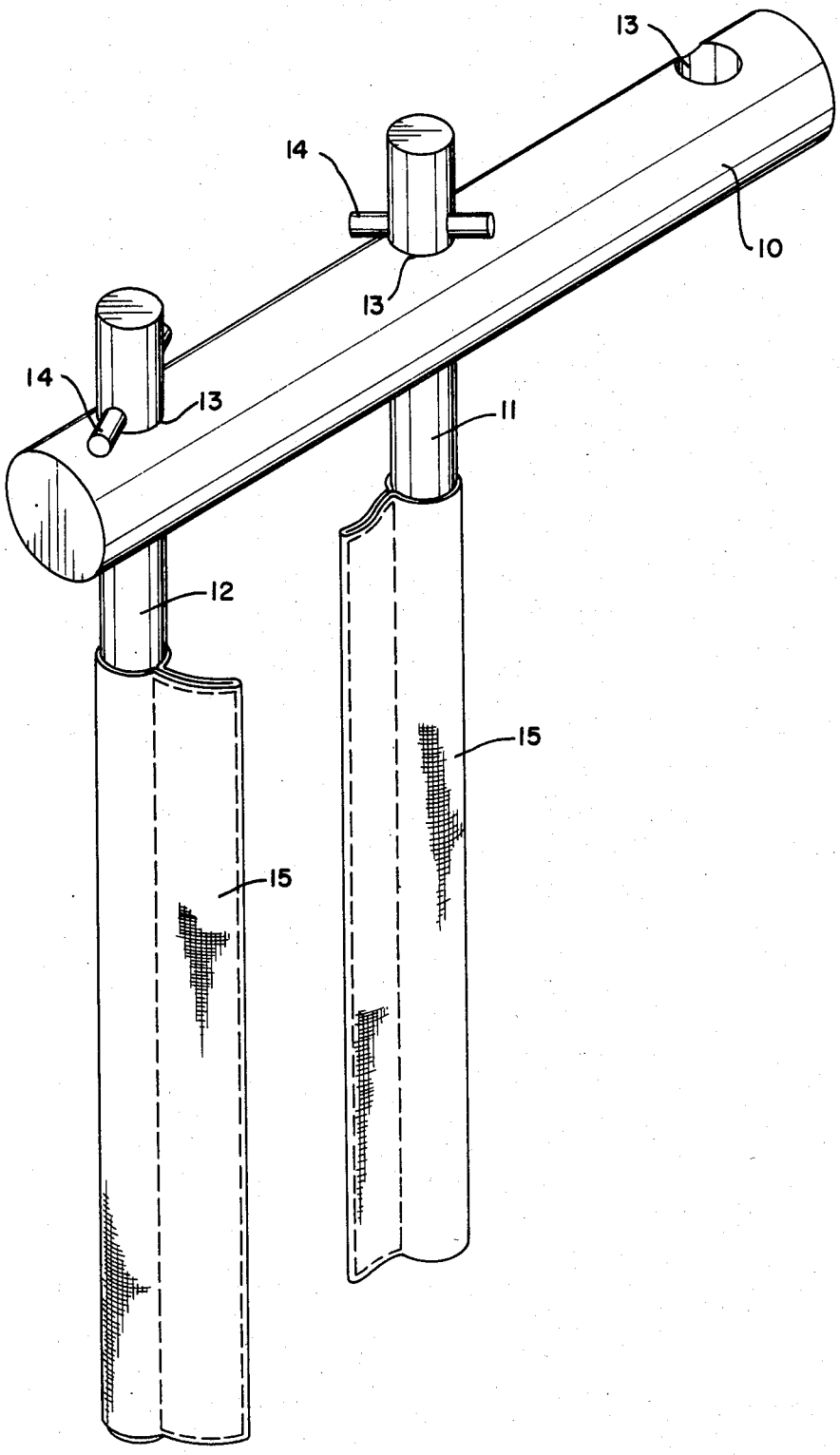
13
14
10
13
14
13
11
12
15
15

SMOCKING FRAME

BACKGROUND OF THE INVENTION

The present invention is a hand-held smocking apparatus specifically designed for use with pre-pleated material. Smocking is an ornamental way of sewing gathers in place. Although machines exist suitable for smocking—either free-standing such as U.S. Pat. No. 4323021, or as an attachment for sewing machines—no hand-held device is presently available for smocking. Comparable devices in other needlework arts, as is described in U.S. Pat. No. 4043270, are unsuitable for use in smocking, because such frames (for quilting and crewel) are enclosed on all four sides. On the other hand, the present invention consists of an open-bottom frame or apparatus that does not snag or entangle the garment being made. The four-sided frame system prohibits needlework on finished garments, such as a blouse or dress.

Other frames, also used in needlework, such as embroidery hoop, are unsuited for smocking because such hoops crush the pleats. The present invention is designed for use with pre-pleated finished garments without crushing or damaging the material.

Additionally, the present invention is particularly suited for sewing gathers in place using a variety of stitches. This apparatus may be used with outline stitches, honeycomb smocking, diamond or chevron smocking, mock smocking, wave stitches, or cable smocking to mention just a few of the techniques used in smocking. These stitches are difficult, if not impossible, using the four-sided or enclosed needlework frames mentioned above.

SUMMARY OF THE INVENTION

A hand-held smocking apparatus consisting of a crossbar and at least two fabric covered dowels rotatably and perpendicularly attached to said crossbar is suitable for performing

BRIEF DESCRIPTION OF THE DRAWING

The FIGURE is a perspective view of the preferred embodiment of the invention.

SPECIFIC DESCRIPTION OF THE INVENTION

Referring to the FIGURE, the invention comprises a crossbar 10 with at least two, a preferably three, dowel-receiving slots 13. These slots 13 are particularly adapted to position and attach dowels 11 and 12, said dowels extending perpendicularly to the crossbar 10, and are preferably, rotatably engaged with respect to the crossbar. In the preferred embodiment, dowels 11 and 12 include retaining means 14 for holding the dowels in place. As is shown in the FIGURE, the preferred means ia a perpendicular hold cut into the dowel adapted to receive a retaining pin 14. However, other means of positioning the dowels are contemplated, such as nut and screw means, or plastic retaining caps placed over the end of the dowel, or a cotter pin arrangement.

Dowels 11 and 12 extend outwardly from crossbar 10 and are preferably covered with a strip of fabric 15 positioned as a sleeve covering the dowel. This fabric is designed so that needlework may be snuggly and securely attached to dowels 11 and 12 so that stitching may be performed in the space between dowels 11 and 12. This material may be fabric or plastic or any material through which pins may be inserted to hold the garment or needlework in place.

Although the preferred means of positioning and attaching dowels 11 and 12 to crossbar 10 is holes 13 cut through the crossbar, other methods of attachment may be used. For example, also contemplated is a slot and groove means of attachment. Another means of holding the dowels in place is by tapering the ends of the dowels. The dowels may then be "locked" in place by pushing the tapered end through the holes in the crossbar. It is intended that tapered-end dowels are used in conjunction with the retaining pin, thereby allowing the user to easily rotate the dowels when needed, while also locking the dowels in place when the material is properly positioned.

Although no length has been mentioned for the dowels, practitioners of smocking are most commonly concerned with 16 row pleaters and 24 row pleaters. Accordingly, a 9 inch dowel may be used for a 16 row pleater, and a 13 inch dowel for the 24 row pleater.

As is mentioned above, at least two dowel-receiving slots are preferred. Experience has shown, however, that three or four slots provide greater adaptability by increasing the distance within which work may be performed. For example, needlework performed on larger garments is more suited to dowels positioned further apart. Additional slots positioned along the crossbar provide this adaptability.

We claim:

1. A three sided smocking apparatus comprising at least two dowel-receiving slots, said slots being positioned at predetermined positions along a crossbar; and a plurality of dowels extending perpendicularly from said crossbar and passing through said dowel receiving slots to be rotatably supported therein, a first end portion of said dowels containing a retaining means for holding the dowels in place on said crossbar, and a second end portion of said dowels being open ended to provide an unobstructed access to said crossbar, said dowels containing fabric retaining means attached thereon to receive and support a needlework material therebetween.

2. A smocking apparatus of claim 1 wherein said dowels are slightly tapered.

3. A smocking apparatus of claim 1 wherein said fabric retaining means consist of material capable of positioning cloth by means of pins.

* * * * *